US011540959B1

(12) United States Patent
Kohlman

(10) Patent No.: US 11,540,959 B1
(45) Date of Patent: Jan. 3, 2023

(54) THERAPY SEAT CUSHION WITH INTERSPERSED SELECTIVELY INFLATABLE LOAD BEARING CELLS AND OFF LOADING CUSHIONING CELLS

(71) Applicant: Steven Paul Kohlman, Holmen, WI (US)

(72) Inventor: Steven Paul Kohlman, Holmen, WI (US)

( * ) Notice: Subject to any disclaimer, the term of this patent is extended or adjusted under 35 U.S.C. 154(b) by 315 days.

(21) Appl. No.: 16/509,028

(22) Filed: Jul. 11, 2019

(51) Int. Cl.
*A61G 5/10* (2006.01)
*A61G 7/057* (2006.01)

(52) U.S. Cl.
CPC ..... *A61G 5/1043* (2013.01); *A61G 5/1091* (2016.11); *A61G 7/05776* (2013.01); *A61G 2203/34* (2013.01); *A61G 2203/70* (2013.01)

(58) Field of Classification Search
CPC ..... A61G 5/1043; A61G 5/1091; A61G 7/05776; A61G 2203/34; A61G 2203/70; A47C 27/083
See application file for complete search history.

(56) References Cited

U.S. PATENT DOCUMENTS 2,938,570 A 5/1960 Flajole
2,998,817 A 9/1961 Armstrong
3,148,391 A 9/1964 Whitney
3,705,429 A 12/1972 Nail
4,175,297 A 11/1979 Robbins et al.
4,190,286 A 2/1980 Bentley
4,394,784 A * 7/1983 Swenson ..... A47C 27/082 415/121.3
4,405,681 A * 9/1983 McEvoy ..... A47C 7/18 428/309.9
4,617,690 A 10/1986 Grebe
4,753,480 A * 6/1988 Morell ..... A47C 27/148 297/452.27
4,912,788 A 4/1990 Lonardo
4,930,171 A * 6/1990 Frantz ..... A61G 5/1048 5/654
5,020,176 A * 6/1991 Dotson ..... A47C 27/082 137/487.5
5,052,068 A 10/1991 Graebe
5,103,518 A 4/1992 Gilroy et al.
5,109,560 A 5/1992 Uetake
5,121,513 A 6/1992 Thomas et al.
5,163,196 A 11/1992 Graebe et al.
5,369,828 A * 12/1994 Graebe ..... A47C 4/54 5/654
5,390,384 A 2/1995 Dinsmoor, III et al.
5,419,612 A 5/1995 Rassekhi
(Continued)

OTHER PUBLICATIONS

Herman Miller, "The Art of Pressure Distribution", 2005.

*Primary Examiner* — Myles A Throop
(74) *Attorney, Agent, or Firm* — Sherrill Law Offices, PLLC; Michael Sherrill

(57) ABSTRACT

A therapy seat cushion, method of making the cushion and method of using the cushion. The cushion has a planar array of at least two sets of alternatively inflatable and deflatable cells controlled by an inflation control system, and at least one non-inflatable offloading cushioning cell interspersed amongst the inflatable cells. The non-inflatable offloading cushioning cell configured and arranged to align with a pressure sore or an area prone to development of a pressure sore on an individual.

15 Claims, 4 Drawing Sheets

(56) References Cited

U.S. PATENT DOCUMENTS 5,427,331 A 6/1995 Stroud
5,473,313 A 12/1995 Graebe, Jr.
5,487,197 A 1/1996 Iskra, Jr. et al.
5,500,965 A * 3/1996 Hannagan ..... A61G 7/05776 297/452.41
5,502,855 A 4/1996 Graebe
5,551,107 A * 9/1996 Graebe ..... A47C 4/54 5/654
5,613,257 A 3/1997 Graebe
5,678,265 A 10/1997 Meyer
5,687,438 A 11/1997 Biggie et al.
5,701,622 A 12/1997 Biggie et al.
5,839,140 A 11/1998 Wilkerson
5,845,352 A * 12/1998 Matsler ..... A61G 5/1045 5/654
5,848,450 A 12/1998 Oexman et al.
5,918,336 A 7/1999 Lee et al.
5,963,997 A 10/1999 Hagopian
6,014,784 A 1/2000 Taylor et al.
6,036,271 A 3/2000 Wilkinson et al.
6,092,249 A 7/2000 Kamen et al.
6,094,762 A 8/2000 Viard et al.
6,115,860 A 9/2000 Vrzalik
6,135,550 A 10/2000 Tucho
6,216,299 B1 4/2001 Kohlman
6,367,106 B1 * 4/2002 Gronsman ..... A47C 27/18 5/709
6,392,166 B1 5/2002 Fortune et al.
6,583,610 B2 6/2003 Groom et al.
6,591,437 B1 7/2003 Phillips
6,623,080 B2 9/2003 Clapper
6,668,405 B1 12/2003 Kohlman
6,671,911 B1 * 1/2004 Hill ..... A61G 5/1043 5/655.3
6,695,798 B2 2/2004 Chang
6,823,549 B1 11/2004 Hampton et al.
6,848,135 B1 2/2005 Kohlman
6,859,967 B2 3/2005 Harrison et al.
7,055,199 B2 6/2006 Thompson
7,392,557 B1 7/2008 Kohlman
7,455,355 B1 11/2008 Kohlman
7,996,940 B1 * 8/2011 Dahm ..... A47C 27/18 5/654
2003/0030319 A1 * 2/2003 Clapper ..... B60N 2/914 297/452.41
2006/0168734 A1 8/2006 Glass
2007/0294831 A1 12/2007 Siekman et al.
2010/0288291 A1 11/2010 Friedman
2014/0090178 A1 * 4/2014 Morgan ..... A61G 7/05715 5/740
2014/0101862 A1 * 4/2014 Misaki ..... A61G 7/05738 5/710
2015/0113735 A1 * 4/2015 Anderson ..... A61G 7/05769 5/654
2017/0251823 A1 * 9/2017 Nakamura ..... A47C 27/082
2018/0160821 A1 * 6/2018 Chapin ..... A47C 27/083
2019/0029902 A1 * 1/2019 Darnold ..... G16H 40/40

* cited by examiner

THERAPY SEAT CUSHION WITH INTERSPERSED SELECTIVELY INFLATABLE LOAD BEARING CELLS AND OFF LOADING CUSHIONING CELLS

BACKGROUND

Persons with limited mobility, such as the elderly or persons confined to a wheelchair, are susceptible to the development of pressure sores. Pressure sores are formed when the tissue is compressed for extended periods of time causing a restriction in the flow of blood. The exchange of nutrients and waste in the compressed tissue cells is slowed, resulting in skin breakdown and the formation of pressure sores. The retention of heat and moisture are two additional factors that contribute to the formation of pressure sores.

U.S. Pat. Nos. 4,175,297, 5,500,965, 5,839,140, 5,963,997, 6,014,784, 6,216,299, 6,560,803, 6,668,405 and 7,392,557 disclose inflatable seat cushions wherein the cushion includes an array of inflatable cells including separate groupings of cells which are alternately inflated and deflated on a predetermined schedule in order to vary the location of contact between the cushion and the posterior of a person seated on the cushion. The disclosure of these United States Patents are incorporated by reference.

While effective for reducing the development of discomfort, numbness, pain and pressure sores resulting from prolonged periods of sitting, such seat cushions are not well adapted for use with an individual who has one or more pressure sores on their buttocks. The cells directly underneath the pressure sore(s) will press against the pressure sore(s) when those cells are inflated, causing pain and aggravating the pressure sore(s).

Accordingly, a need exists for a comfortable inflatable wheelchair seat cushion that accommodates preexisting pressure sores.

SUMMARY OF THE INVENTION

A first aspect of the invention is a therapy seat cushion. The cushion includes a planar array of cells and an inflation control system. The array of cells includes (i) a first set of at least two mutually inflatable and deflatable first cells, (ii) a second set of at least two mutually inflatable and deflatable second cells, and (iii) at least one non-inflatable offloading cushioning cell. The first and second set of cells are load bearing cells when inflated. The inflation control system includes (a) a pump, (b) an input valve with accompanying tubing operable to mutually exclusively place the pump in fluid communication with either the first set of cells or the second set of cells, (c) a pressure sensor in selective fluid communication with the first or second set of cells while the set of cells are being inflated, and (d) a microprocessor in electrical communication with the pump, input valve and pressure sensor for periodically alternating inflation and deflation of the first and second set of cells to a predetermined inflation pressure.

A second aspect of the invention is a wheelchair equipped with a therapy seat cushion according to the first aspect of the invention.

A third aspect of the invention is a method of custom manufacturing a therapy seat cushion according to the first aspect of the invention. The method includes the steps of (A) positioning an offloading cushioning cell on the therapy seat cushion to align with a pressure sore or an area prone to development of a pressure sore on the individual client when the individual client is seated upon the therapy seat cushion, and (B) interspersing the first and second sets of cells throughout the balance of the therapy seat cushion.

A fourth aspect of the invention is a method of using a therapy seat cushion according to the first aspect of the invention. The method includes the steps of (1) sitting upon the therapy seat cushion whereby a pressure sore or an area prone to development of a pressure sore rests upon an offloading cushioning cell on the therapy seat cushion, and (2) periodically alternating inflation and deflation of the first and second sets of cells so as to relocate the areas on the body bearing the majority of the seated load bearing weight.

DETAILED DESCRIPTION OF A PREFERRED EMBODIMENT

Definitions

As utilized herein in connection with a therapy seat cushion having both inflatable load bearing cells and at least one offloading cushioning cell, including the claims, the phrase "offloading cushioning cell" means a cell operable and effective for providing cushioning (e.g., a "soft foam") and which provides minimal load bearing support relative to the inflatable load bearing cells on the seat cushion when they are inflated.

As utilized herein, including the claims, references to "softness and hardness of a foam" refer to IFD measured firmness, with softer foams having a smaller IFD value and harder foams having a larger IFD value.

As utilized herein, including the claims, "soft foam" means foam having an IFD value of less than about 20 lbs.

As utilized herein, including the claims, "balanced foam" means a foam having an IFD value of greater than about 20 lbs and less than about 40 lbs.

As utilized herein, including the claims, a "hard foam" means a foam having an IFD value of greater than about 40 lbs.

As utilized herein, including the claims, the acronym "IFD" refers to Indentation Force Deflection at 25% compression as measured in accordance Method B1 of ASTM D3574.

Nomenclature

| Reference No. | Name |
|---|---|
| 10 | Therapy Seat Cushion |
| 20 | Base Layer |
| 30 | Array of Cells |
| 31 | First Inflatable Cells |
| 32 | Second Inflatable Cells |
| 33 | Offloading Cushioning Cells |

-continued

| Reference No. | Name |
|---|---|
| 33a | Uppermost Exposed Surface of Offloading Cushioning Cells |
| 40 | Top Cushioning Layer |
| 49 | Opening Through Top Cushioning Layer |
| 51 | First Tubing Interconnecting First Set of Inflatable Cells |
| 52 | Second Tubing Interconnecting Second Set of Inflatable Cells |
| 61 | Compressor |
| 62 | Solenoid Valves |
| $63_1$ | First Pressure Sensor |
| $63_2$ | Second Pressure Sensor |
| 64 | Battery |
| 65 | Controller (Microprocessor) |
| 70 | Remote Control |
| 80 | Seat Cover |
| 100 | Wheelchair |

Construction

Figure 1:
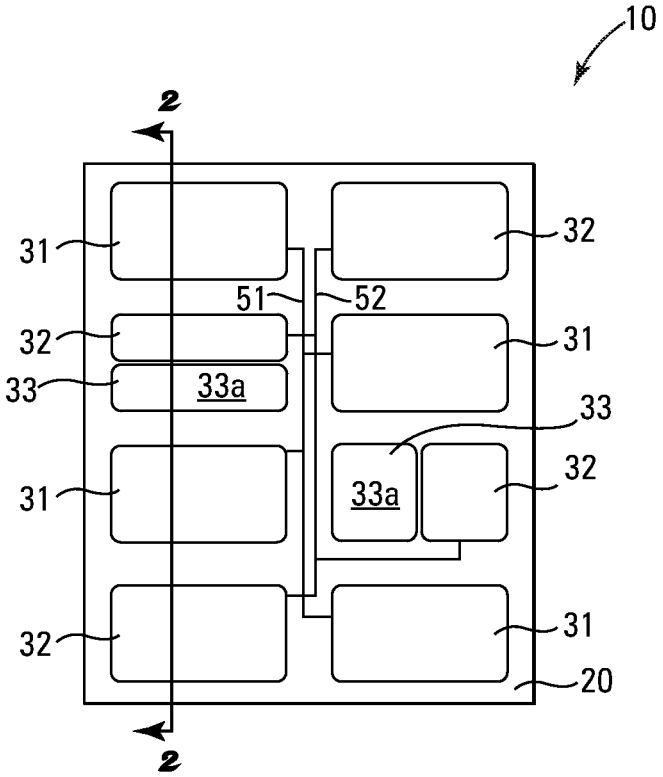
FIG. 1 is a top view of one embodiment of the selectively inflatable therapy seat cushion in accordance with the invention, sans cover and top cushioning layer to facilitate depiction of the inflatable and offloading cushioning cells.
Figure 2:
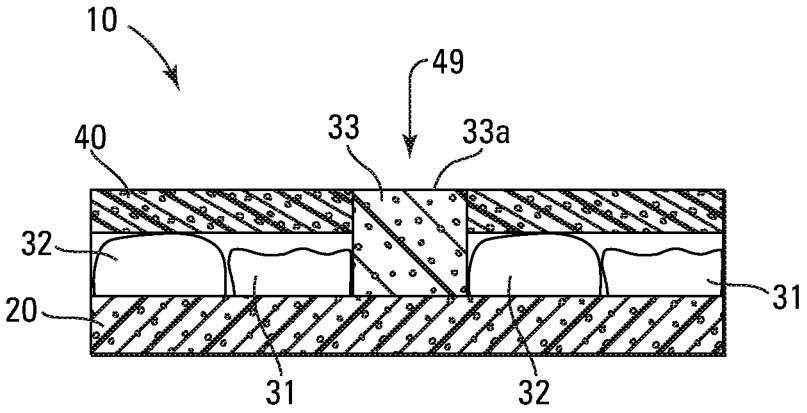
FIG. 2 is a cross-sectional side view of the cushion depicted in FIG. 1, with inclusion of the top cushioning layer.
Figure 3:
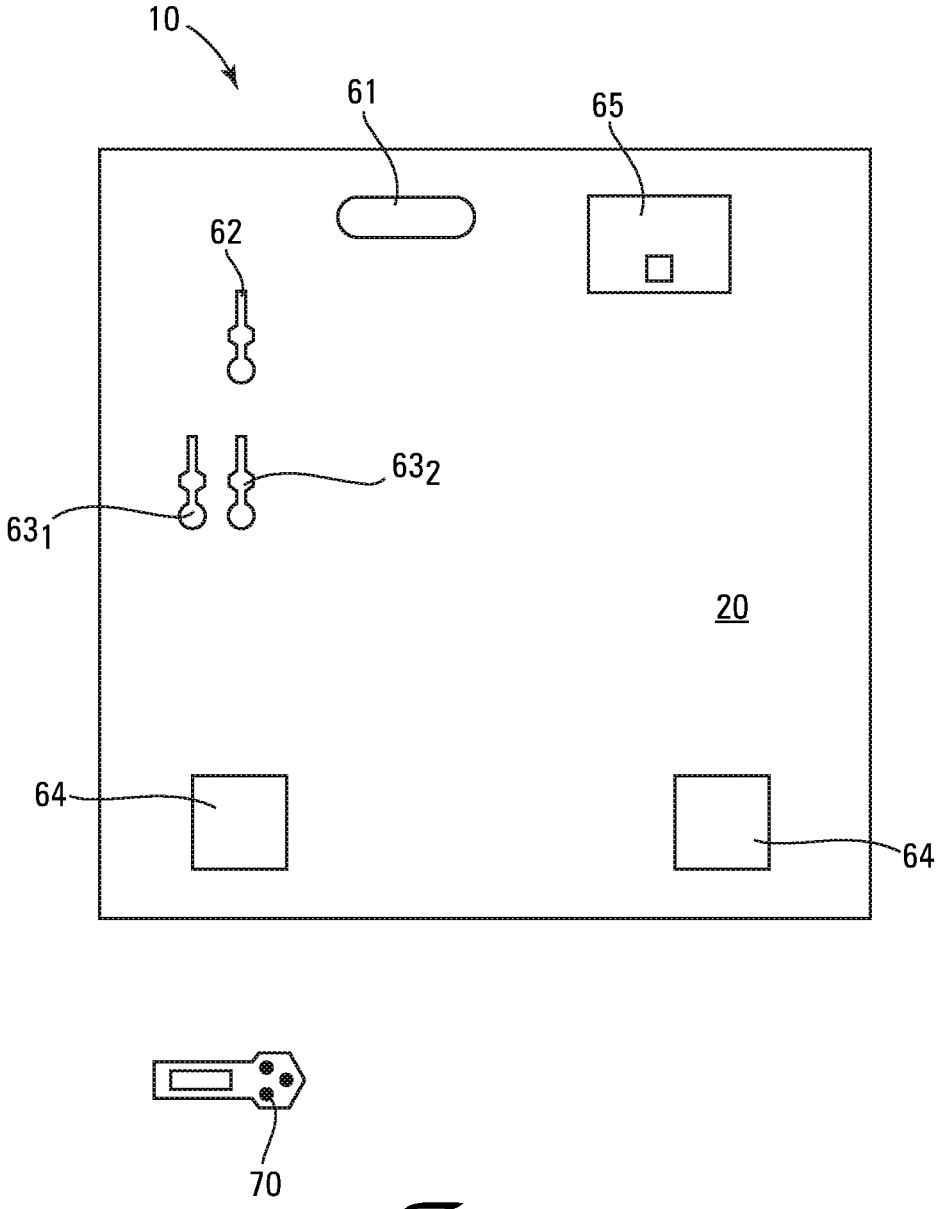
FIG. 3 is a pneumatic and electrical schematic of the electronic components of the invention depicted in FIG. 1.
Figure 4:
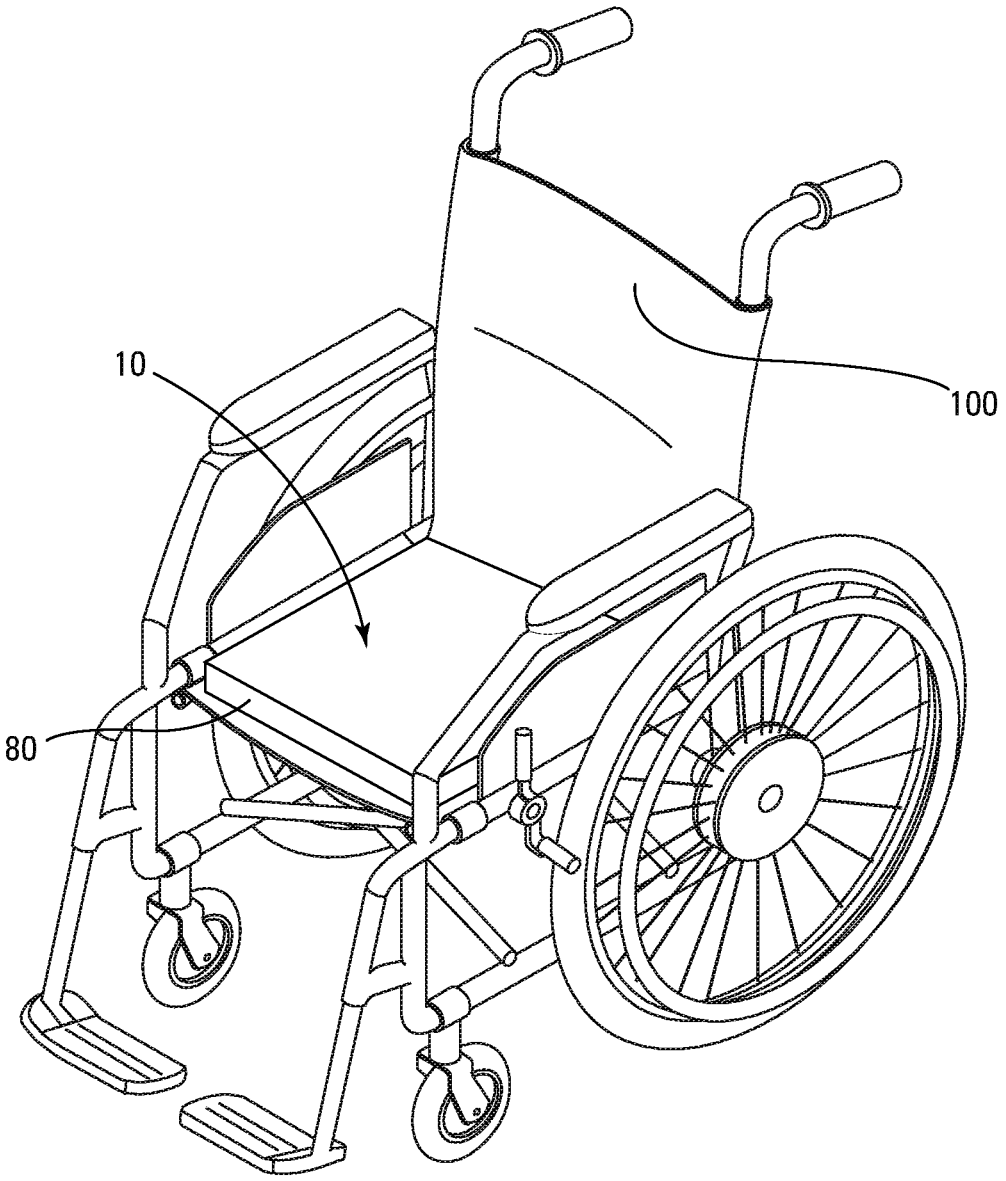
FIG. 4 is a perspective view of a wheelchair equipped with the cushion depicted in FIG. 1 with top cushioning layer and cover.

Referring to FIGS. 1-3, the therapy seat cushion 10 is a planar array of cells 30 and an inflation control system (not collectively numbered). The planar array of cells 30 overlays a base layer 20 and are preferably sandwiched between the base layer 20 and a top cushioning layer 40.

Referring to FIGS. 1 and 2, the array of cells 30 includes a first set of at least two mutually inflatable and deflatable first cells 31, a second set of at least two mutually inflatable and deflatable second cells 32, and at least one non-inflatable offloading cushioning cell 33. The first and second cells 31 and 32 are load bearing cells when inflated.

Referring to FIG. 1, the set of first cells 31 are preferably fluidly interconnected with one another by first tubing 51 whereby the first cells 31 share a common inflation pressure, and the set of second cells 32 are preferably fluidly interconnect with one another by second tubing 52 whereby the second cells 32 share a common inflation pressure.

The non-inflatable offloading cushioning cell(s) 33 is interspersed amongst the first and second inflatable and deflatable cells 31 and 32. The offloading cushioning cell(s) 33 is constructed to provide minimal support to a seated user when one or both of the first and/or second inflatable and deflatable cells 31 and 32 are inflated, while providing at least some modest cushioning in the event the cushion 10 bottoms out for a period of time. The offloading cushioning cell 33 is preferably constructed from a soft foam (i.e., a foam having an IFD value of less than about 20 lbs), but can be constructed from a balanced foam (i.e., a foam having an IFD value of greater than about 20 lbs and less than about 40 lbs).

Each offloading cushioning cell 33 preferably extends through an opening 49 in the top cushioning layer 40 so as to directly contact the buttock of a seated user.

Each offloading cushioning cell 33 is preferably sized, shaped, configured and arranged to present an uppermost exposed surface 33*a* (i.e., the surface area which will contact the buttock of a seated user) with an area of at least 4 $cm^2$, preferably at least 8 $cm^2$, and an aspect ratio of length to width of at least 0.2, preferably 0.3. An uppermost exposed surface 33*a* having an area of less than about 4 $cm^2$ or an aspect ratio of length to width of less than about 0.2 imposes significant complications in matching the uppermost exposed surface 33*a* with a existing pressure sore or an area prone to development of a pressure sore on the buttock of a seated user.

The base layer 20 and the top cushioning layer 40 are preferably constructed of a compliant material, such as open or closed cell foam, with the top cushioning layer 40 constructed from a softer foam than the base layer 20.

The electronic inflation components can be embedded within the base layer 20 such as depicted and described in U.S. Pat. Nos. 6,014,784 and 6,560,803 and schematically in FIG. 3, or retained within a separate housing such as depicted and described in U.S. Pat. Nos. 5,500,965, 5,963,997, 6,216,299, 6,668,405 and 7,392,557.

Persons of skill in the art are capable of constructing selectively inflatable seat cushions as evidenced by the numerous United States Patents directed to such cushions, including U.S. Pat. Nos. 4,175,297, 5,500,965, 5,839,140, 5,963,997, 6,014,784, 6,216,299, 6,560,803, 6,668,405 and 7,392557, the disclosures of which are incorporated by reference.

The electronic inflation components include those typically employed in selectively inflatable seat cushions, including specifically but not exclusively one or more pumps or compressors 61, one or more solenoid valves 62, one or more check valves (not shown), one or more pressure sensors 631 and 632, one or more batteries 64, and a controller 65.

The electronic inflation components periodically alternate inflation and deflation of the first and second set of cells to a predetermined inflation pressure so as to periodically change the area of the buttock supported by the cushion 10.

The seating cushion 10 preferably includes a wired or wireless remote control 70 for allowing a user to set and/or adjust inflation and deflation settings.

The cushion 10 is preferably enclosed within a removable cover 80. The cover 80 can be provided with a zipper (not shown) so that the cover 80 may be removed and laundered or replaced. An opening (not shown), is preferably provided along a seam (not shown) to permit passage of delivery and return tubes 51 and 52 through the cover 80 when the electronic inflation components are retained within a separate housing.

The cushion 10 may be employed as a portable overlay or may be incorporated directly into the seat (not shown).

The seating cushion 10 can be used in connection with any type of seating including standard residential and office chairs, airplane seats, vehicle seating, etc. but is particularly suited for use with a wheelchair 100.

Method of Manufacture

The cushion 10 is preferably custom manufactured for each individual client by (i) positioning an offloading cushioning cell 33 on the therapy seat cushion 10 to align with a pressure sore or an area prone to development of a pressure sore on the individual client when the individual client is seated upon the therapy seat cushion 10, and (ii) interspersing the first and second sets of cells (31 and 32) throughout the balance of the therapy seat cushion 10.

Method of Use

The cushion 10 is best used by (i) sitting upon the therapy seat cushion 10 whereby a pressure sore or an area prone to development of a pressure sore rests upon an offloading cushioning cell 33 on the therapy seat cushion 10, and (ii) periodically alternating inflation and deflation of the first and second sets of cells (31 and 32) so as to relocate the areas on the body bearing the majority of the seated load bearing weight.

I claim:

1. A therapy seat cushion comprising:

(a) a planar array of cells, including an interspersed arrangement of at least:

(i) a first set of at least two mutually inflatable and deflatable cells comprising load bearing cells when inflated, (ii) a second set of at least two mutually inflatable and deflatable cells comprising load bearing cells when inflated, and (iii) at least one non-inflatable offloading cushioning cell interposed between two inflatable and deflatable cells, (iv) wherein the first and second sets of cells are sandwiched between an upper layer and a lower layer of foam and the offloading cushioning cell extends through an opening in the upper layer of foam, and (b) an inflation control system including at least:

(A) a pump, (B) an input valve with accompanying tubing operable to mutually exclusively place the pump in fluid communication with either the first set of cells or the second set of cells, (C) a pressure sensor in selective fluid communication with the first or second set of cells while the set of cells are being inflated, and (D) a microprocessor in electrical communication with the pump, input valve and pressure sensor for periodically alternating inflation and deflation of the first and second set of cells to a predetermined inflation pressure.

2. The therapy seat cushion of claim 1 wherein (i) the first set of cells fluidly interconnect with one another whereby the cells comprising the first set of cells share a common inflation pressure, and (ii) the second set of cells fluidly interconnect with one another whereby the cells comprising the second set of cells share a common inflation pressure.

3. The therapy seat cushion of claim 1 wherein the upper layer of foam is a softer foam than the lower layer of foam.

4. The therapy seat cushion of claim 1 wherein the offloading cushioning cell is comprised of a soft foam.

5. The therapy seat cushion of claim 1 wherein the offloading cushioning cell is comprised of a balanced foam.

6. The therapy seat cushion of claim 1 wherein an uppermost exposed surface of the offloading cushioning cell has an aspect ratio of at least 0.2.

7. The therapy seat cushion of claim 6 wherein an uppermost exposed surface of the offloading cushioning cell has an area of at least 4 $cm^2$.

8. The therapy seat cushion of claim 1 wherein an uppermost exposed surface of the offloading cushioning cell has an aspect ratio of at least 0.3.

9. The therapy seat cushion of claim 8 wherein an uppermost exposed surface of the offloading cushioning cell has an area of at least 8 $cm^2$.

10. The therapy seat cushion of claim 1 further comprising a remote control operable for providing user control of the inflation control system.

11. A method of using a therapy seat cushion according to claim 10 comprising the steps of:

(a) sitting upon the therapy seat cushion whereby a pressure sore or an area prone to development of a pressure sore rests upon an offloading cushioning cell on the therapy seat cushion, and (b) periodically alternating inflation and deflation of the first and second sets of cells so as to relocate the areas on the body bearing the majority of the seated load bearing weight.

12. A wheelchair equipped with the therapy seat cushion of claim 1.

13. A method of custom manufacturing a therapy seat cushion according to claim 1 for an individual client, comprising the steps of:

(a) positioning the offloading cushioning cell on the therapy seat cushion to align with a pressure sore or an area prone to development of a pressure sore on the individual client when the individual client is seated upon the therapy seat cushion, and (b) interspersing the first and second sets of cells throughout the balance of the therapy seat cushion.

14. A method of custom manufacturing a therapy seat cushion according to claim 1 for an individual client, comprising the steps of:

(a) positioning the offloading cushioning cell on the therapy seat cushion to align with each pressure sore or area prone to development of a pressure sore on the individual client when the individual client is seated upon the therapy seat cushion, and (b) interspersing the first and second sets of cells throughout the balance of the therapy seat cushion.

15. A method of using a therapy seat cushion according to claim 1 comprising the steps of:

(a) sitting upon the therapy seat cushion whereby a pressure sore or an area prone to development of a pressure sore rests upon an offloading cushioning cell on the therapy seat cushion, and (b) periodically alternating inflation and deflation of the first and second sets of cells so as to relocate the areas on the body bearing the majority of the seated load bearing weight.

* * * * *